US008596479B2

(12) United States Patent
Simon et al.

(10) Patent No.: US 8,596,479 B2
(45) Date of Patent: Dec. 3, 2013

(54) HOT-FILL CONTAINER

(75) Inventors: John B. Simon, Farmington Hills, MI (US); Walter J. Strasser, Cement City, MI (US); Anna C. Wilcox, New York, NY (US)

(73) Assignee: Amcor Limited, Hawthorn (AU)

( * ) Notice: Subject to any disclaimer, the term of this patent is extended or adjusted under 35 U.S.C. 154(b) by 250 days.

(21) Appl. No.: 12/342,913

(22) Filed: Dec. 23, 2008

(65) Prior Publication Data

US 2010/0155359 A1 Jun. 24, 2010

(51) Int. Cl.
*B65D 90/02* (2006.01)

(52) U.S. Cl.
USPC ..... 215/382; 215/381; 220/669

(58) Field of Classification Search
USPC ..... 215/382, 383, 384, 379, 381, 900; 220/669, 672, 675, 673
See application file for complete search history.

(56) References Cited

U.S. PATENT DOCUMENTS

| | | | | |
|---|---|---|---|---|
| 5,632,397 | A * | 5/1997 | Fandeux et al. | 215/382 |
| D404,311 | S * | 1/1999 | Zimmer et al. | D9/552 |
| D412,281 | S * | 7/1999 | Lindsay et al. | D9/500 |
| 7,163,123 | B2 * | 1/2007 | Bezek | 220/675 |
| 2006/0108318 | A1 | 5/2006 | Chisholm | |
| 2006/0283832 | A1 * | 12/2006 | De Cleir et al. | 215/383 |
| 2008/0073315 | A1 | 3/2008 | Hermel et al. | |

FOREIGN PATENT DOCUMENTS

| | | |
|---|---|---|
| CO | 6310982 | 8/2011 |
| JP | 07-172424 | 7/1995 |
| JP | 2004-507405 | 3/2004 |
| WO | WO 01/12511 | 2/2001 |
| WO | WO 02/18213 | 3/2002 |
| WO | WO 2007/006880 | * 1/2007 |
| WO | WO 2009/140335 | 11/2009 |

OTHER PUBLICATIONS

WO2007006880 english translation.*
Office Action dated Jun. 15, 2012 in corresponding Chilean Patent Application No. 1555-11 (seven pages).
Office Action dated Jun. 18, 2013 in corresponding Colombian Patent Application No. 11-77775 (ten pages).

* cited by examiner

*Primary Examiner* — Jeffrey Allen
(74) *Attorney, Agent, or Firm* — Harness, Dickey & Pierce, P.L.C.

(57) ABSTRACT

A one-piece plastic hot-fill container may employ a shoulder portion, a base portion and a sidewall portion, which may be integrally formed with and extend from the shoulder portion to the base portion. The sidewall portion may generally be in an hourglass shape and employ a plurality of arched contour ribs and a plurality of arched contour lands that may alternate along a longitudinal length of the sidewall portion. An outside diameter of an upper body portion is greater than an outside diameter of a lower body portion, which may form a hand grip area. The arched contour ribs may further employ an upper flat wall, a lower flat wall, and an inner curved wall joining the upper and lower walls, which together may form an angle of about 60 degrees, and move in response to hot-fill product contraction within the container or top load forces.

17 Claims, 4 Drawing Sheets

HOT-FILL CONTAINER

FIELD

The present disclosure relates to a hot-fill, heat-set container with vacuum absorbing ribs on a contoured body of the container.

BACKGROUND

The statements in this section merely provide background information related to the present disclosure and may not constitute prior art. Hot-fill plastic containers, such as those manufactured from polyethylene terephthalate ("PET"), have been commonplace for the packaging of liquid products, such as fruit juices and sports drinks, which must be filled into a container while the liquid is hot to provide for adequate and proper sterilization. Because these plastic containers are normally filled with a hot liquid, the product that occupies the container is commonly referred to as a "hot-fill product" or "hot-fill liquid" and the container is commonly referred to as a "hot-fill container." During filling of the container, the product is typically dispensed into the container at a temperature of at least 180° F. Immediately after filling, the container is sealed or capped, such as with a threaded cap, and as the product cools to room temperature, such as 72° F., a negative internal pressure or vacuum pressure builds within the sealed container. Although PET containers that are hot-filled have been in use for quite some time, such containers are not without their share of limitations.

One limitation of PET hot-fill containers is that because such containers receive a hot-filled product and are immediately capped, the container walls contract as a vacuum pressure increases during hot-fill product cooling. Because of this product contraction, hot-fill containers may be equipped with vertical columns and circumferential grooves. The vertical columns and circumferential grooves, which are normally parallel to the container's bottom resting surface, provide strength to the container to withstand container distortion and aid the container in maintaining much of its as-molded shape, despite the internal vacuum pressure. Additionally, hot-fill containers may be equipped with vacuum panels to control the inward contraction of the container walls. The vacuum panels are typically located in specific wall areas immediately beside the vertical columns, and immediately beside and between the circumferential grooves so that the grooves and columns may provide support to the moving, collapsing vacuum panels yet maintain much of the overall shape of the container. Because of the necessity of the traditional vacuum panels in the container wall and support grooves above and below the vacuum panels to assist in maintaining the overall container shape, incorporating contour hand grips and other contours in the container wall, while preserving the ability of the container wall to absorb internal vacuum, is limited.

What is needed then is a hot-fill container with a wall that is capable of moving to absorb internal vacuum pressure in response to cooling of an internal hot-fill liquid and capable of maintaining the overall shape of the container while providing a contoured hand grip area.

SUMMARY

This section provides a general summary of the disclosure, and is not a comprehensive disclosure of its full scope or all of its features. A one-piece plastic container may employ a shoulder portion, a base portion closing off the end of the container, and a sidewall portion integrally formed with and extending from the shoulder portion to the base portion. The sidewall portion may further employ a plurality of arched contour ribs and a plurality of arched contour lands which together may alternate along a longitudinal length of the sidewall portion. The contour ribs may be non-horizontal and traverse the perimeter of the container in a flowing, or up and down, design. The sidewall portion may further employ a convex upper body portion and a concave lower body portion such that an outside diameter of the upper body portion is greater than an outside diameter of the lower body portion, which forms a hand grip area. The arched contour ribs may further employ an upper flat wall, a lower flat wall, and an inner curved wall tangentially joining the upper and lower flat walls, which form an angle of approximately 60 degrees. Either or both of the upper and lower walls may pivot, or the inner curved wall may pivot, and be movable toward each other in response to an internal vacuum pressure and/or container top loading forces. The arched contour lands of the lower body portion are concave for gripping by a human hand. An outside diameter of the upper body portion and an outside diameter of the base portion may be equal.

Further areas of applicability will become apparent from the description provided herein. It should be understood that the description and specific examples are intended for purposes of illustration only and are not intended to limit the scope of the present disclosure.

DRAWINGS

The drawings described herein are to scale and are for illustrative purposes only of selected embodiments and not all possible implementations, and are not intended to limit the scope of the present disclosure.

DETAILED DESCRIPTION

Figure 1:
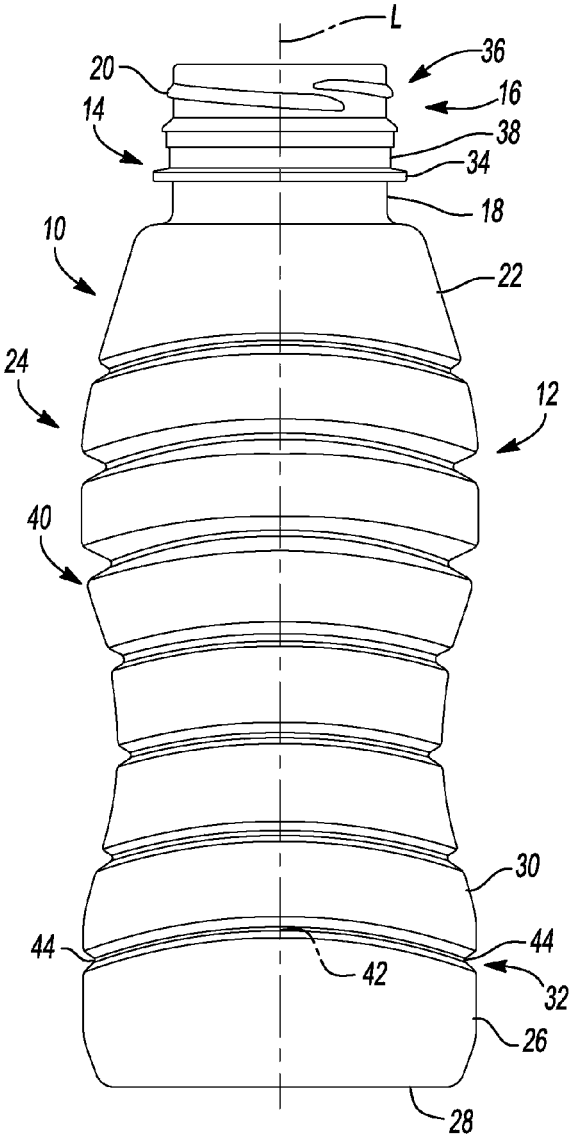
FIG. 1 is a front view of a container containing vacuum absorbing ribs in a contoured gripping area according to the teachings of the present invention.

The following description is merely exemplary in nature and is not intended to limit the present disclosure, application, or uses. It should be understood that throughout the drawings, corresponding reference numerals indicate like or corresponding parts and features. Turning now to FIGS. 1-5, details of a preferred embodiment of the present disclosure will be discussed. Turning first to FIG. 1, a one-piece plastic, e.g. polyethylene terephthalate (PET), container 10 is depicted with a longitudinal axis L and is substantially cylindrical. In this particular embodiment, the plastic container 10 has a volume capacity of about 12 fl. oz. (355 cc/mL).

As depicted in FIG. 1, the one-piece plastic container 10 defines a container body 12 and includes an upper portion 14 having a finish 16 and a neck 18. The finish 16 may have at least one thread 20 integrally formed thereon. A shoulder portion 22 extends downward from the finish 16. The shoulder portion 22 merges into and provides a transition between the finish 16 and a sidewall portion 24. The sidewall portion 24 extends downward from the shoulder portion 22 to a base portion 26 having a base 28, which may employ a contact ring. The sidewall portion 24 may define a series of contoured lands 30 and contoured ribs 32, such as contour land 30 and contour rib 32. The contoured lands and contoured ribs, although traversing around the periphery of the container 10 as depicted in FIGS. 1 and 2, may be arranged vertically from the shoulder portion 22 to the base portion 26, as depicted.

The neck 18 may have an extremely short height, that is, becoming a short extension from the finish 16, or may have an elongated height, extending between the finish 16 and the shoulder portion 22. A circular support ring 34 may be defined around the neck 18. A threaded region 36 with its at least one thread 20 may be formed on an annular sidewall 38 above the support ring 34. The threaded region 36 provides a means for attachment of a similarly threaded closure or cap (not shown). The cap may define at least one thread formed around an inner diameter for cooperatively riding along the thread(s) 20 of the finish 16. Alternatives may include other suitable devices that engage the finish 16 of the plastic container 10. Accordingly, the closure or cap engages the finish 16 to preferably provide a hermetical seal of the plastic container 10. The closure or cap is preferably of a plastic or metal material conventional to the closure industry and suitable for subsequent thermal processing, including high temperature pasteurization and retort. The shoulder portion 22 may define a transition area from the neck 18 and upper portion 14 to a label panel area 40. The label panel area 40 therefore, may be defined between the shoulder portion 22 and the base portion 26, and located on the sidewall portion 24.

The container 10 may include a number of the contour ribs, such as contour rib 32. For instance, the container 10 may contain as few as three (3) contour ribs and as many as nine (9) contour ribs; however, the actual number of contour ribs may depend upon the actual physical size of the container 10 with containers larger than that depicted in FIG. 1 having more contour ribs and those smaller than that depicted in FIG. 1 having fewer contour ribs. Additionally, the contour ribs may not be parallel to the support ring 34 or the base 28. Stated differently, the contour ribs 32 may be arcuate in one or more directions about the periphery of the body 12 and the sidewall portion 24 of the container 10. More specifically, in a first side view as depicted in FIG. 1, the contour ribs 32 may be arced such that a center 42 of the contour ribs 32 is arced upward toward the neck 18. Such may be the case for all of the contour ribs 32 in the container 10 when viewed from the same side of the container 10. However, as depicted in FIG. 2, the contour ribs 32 may be arched in a different, opposite, downward direction, such as toward a bottom of the container 10, as compared to FIG. 1. More specifically, a center 46 of the contour ribs 32 may be closer to the base 28 than either of sides 48. In rotating the container 10 and following the contour ribs 32 for 360 degrees around the container 10, the contour ribs 32 may have two (2) equally high, highest points, and two (2) equally low, lowest points.

Figure 2:
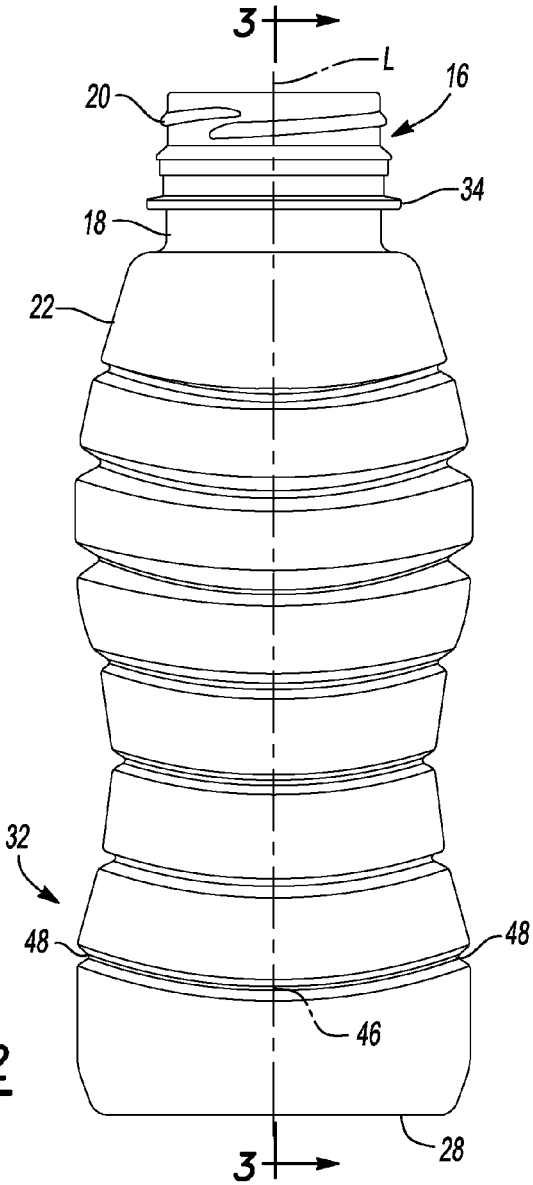
FIG. 2 is a right side view of the container containing vacuum absorbing ribs in a contoured gripping area according to the teachings of the present invention.
Figure 3:
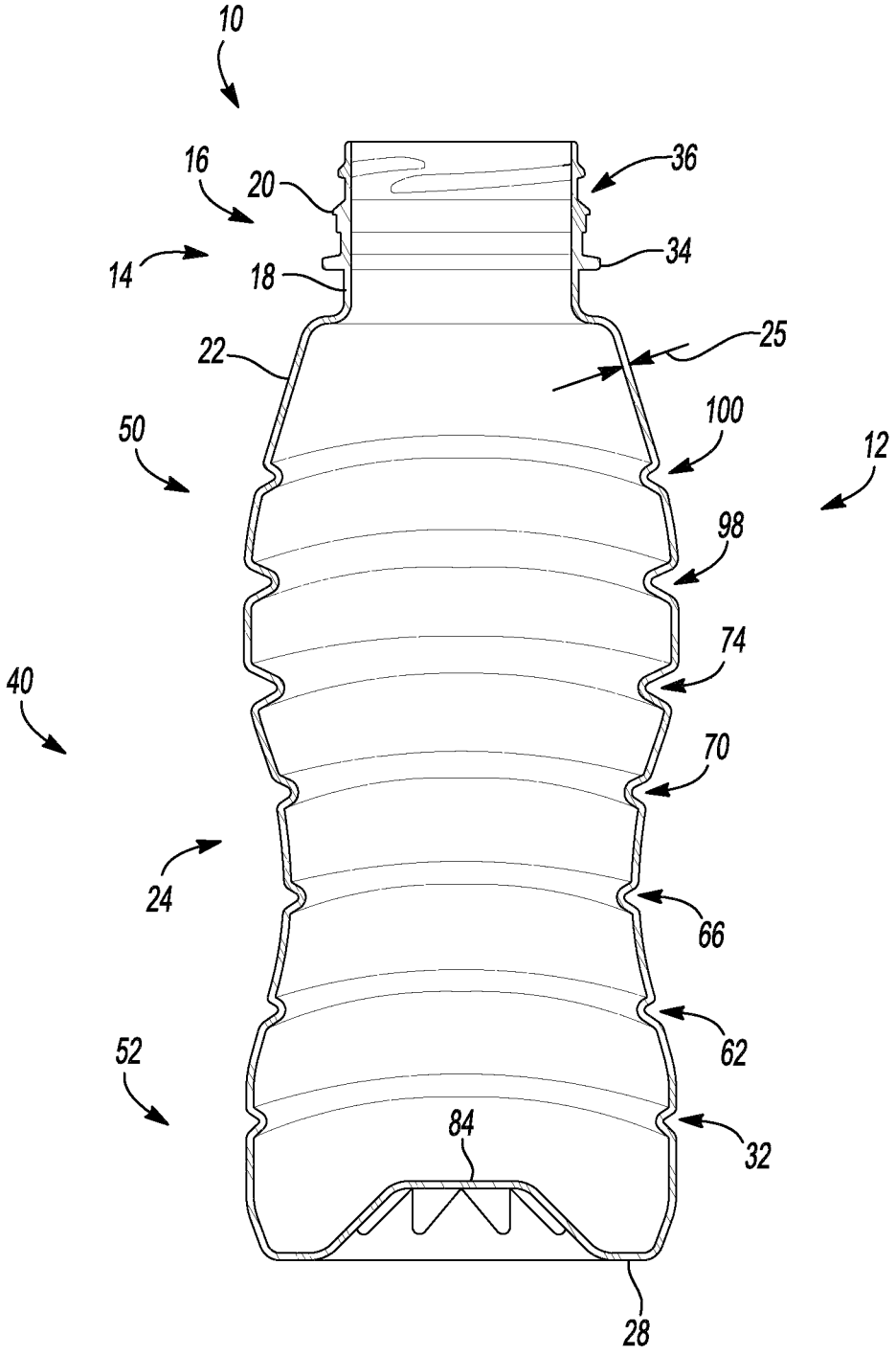
FIG. 3 is a vertical cross-sectional view of the container depicting the ribs and the container wall.

FIG. 3 depicts a vertical cross-section of the container 10 at line 3-3 of FIG. 2. More specifically, the container 10 depicts the cross-sectional profile of the upper portion 14, including the support ring 34 and threads 20 of threaded region 36 of the finish 16. Continuing, FIG. 3 also depicts the shoulder region 22 and the sidewall portion 24, including the label panel area 40, a top body portion 50 and a bottom body portion 52. The label panel area 40 may be any portion of the sidewall portion 24.

The cross-sectional view of FIG. 3 also more clearly depicts the arrangement and depth of the contour ribs 32, 62, 66, 70, 74, 98, 100, which are depicted and discussed later in conjunction with FIGS. 4 and 5. The contour ribs 32, 62, 66, 70, 74, 98, 100, because of their protrusion toward the interior of the container 10, are able to collapse upon themselves to a certain degree when the vacuum within the container 10 reaches a predetermined or prescribed pressure. The pressure at which the contour ribs 32, 62, 66, 70, 74, 98, 100 will collapse upon themselves is dependent not only upon the vacuum pressure within the container 10, but also upon the distance or degree that a specific rib of the container 10 protrudes into the interior volume of the container 10, away from the sidewall portion 24. Generally, the deeper the contour rib 32, 62, 66, 70, 74, 98, 100, the greater the ability of the respective rib to absorb vacuum pressure. For instance, with continued reference to FIG. 3, the contour rib 74 may have a greater ability to absorb internal vacuum pressure than contour rib 62. Additionally, the container 10 depicted in FIG. 3 is intended to be gripped by a human hand in the area of contour ribs 62, 66, and 70. Thus, as a person grips the container 10 over contour ribs 62, 66, and 70 and unscrews a cap (not shown) from the threads 20, air will rush into the container 10 causing the contour ribs 32, 62, 66, 70, 74, 98, 100 to expand or de-contract. Because the contour ribs 74, 98 may be designed to contract and de-contract more than the contour ribs under the grip of a hand, the holder of the container 10 will not lose his or her grip upon decompression of the sidewall portion 24, and more specifically, contour ribs 32, 62, 66, 70, 74, 98, 100. Also, any label at the area under a human hand, will not be distorted or become unglued, for example, during sidewall contraction and expansion. The contour ribs 32, 62, 66, 70, 74, 98, 100 are designed to scale as depicted in order to maximize compressive movement of the sidewall using the contour ribs 32, 62, 66, 70, 74, 98, 100. Another factor that will affect the collapsibility of the opposing walls of the contour ribs 32, 62, 66, 70, 74, 98, 100 is the wall thickness 25 of the container 10, which may vary by location within the container 10, and the actual material of the container 10.

Figure 4:
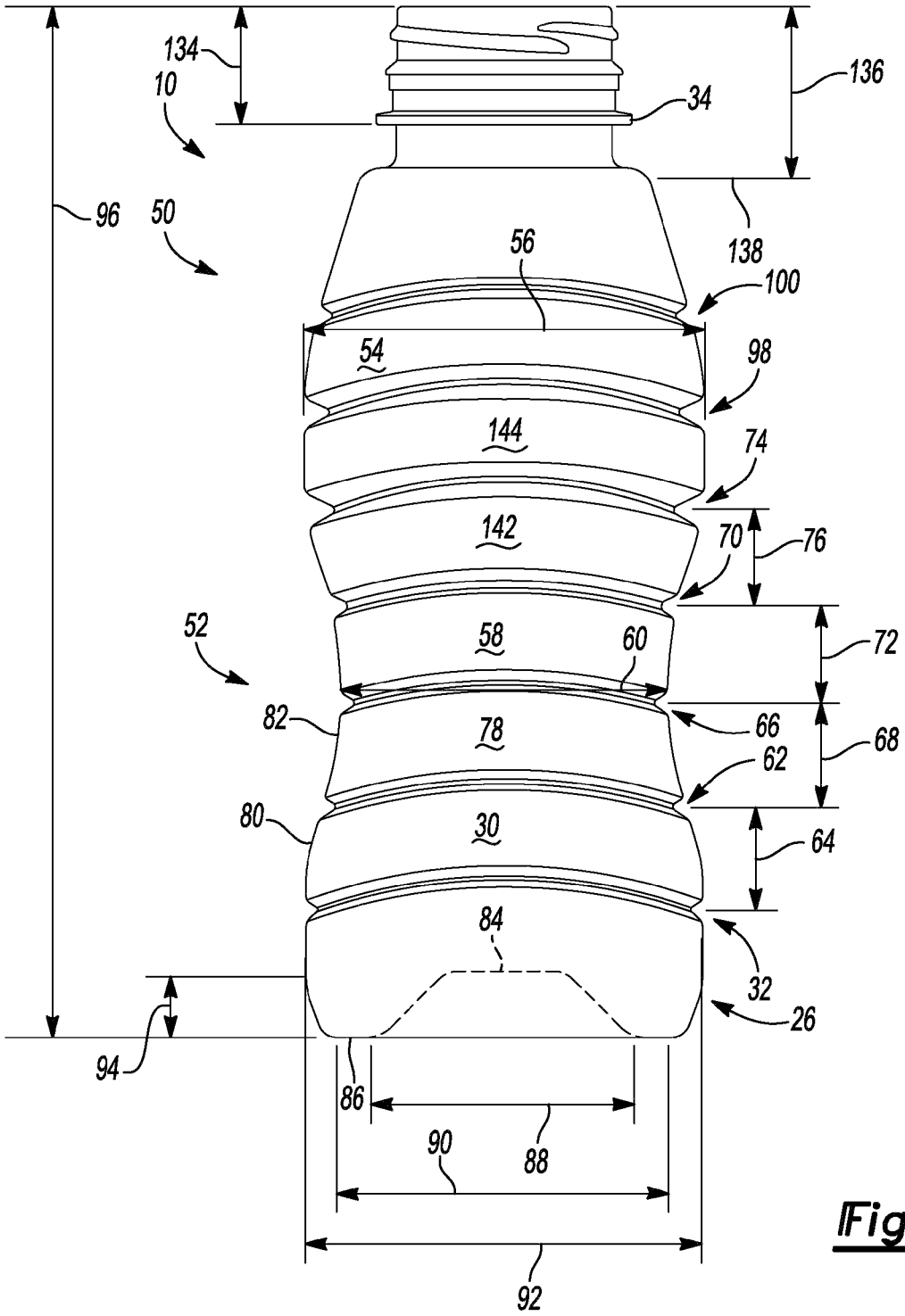
FIG. 4 is front view of the container depicting various contour rib and contour land dimensions.

Turning now to FIG. 4, details of the numerous contour ribs will be discussed. As depicted in FIG. 4, to achieve the desirable overall contour of the container 10, the upper body portion 50 may be of a larger diameter than the lower body portion 52. By designing the container 10 in such a manner, and by incorporating contour ribs 32, 62, 66, 70, 74, 98, 100 as a vacuum absorbing sidewall, which is virtually unnoticeable to the human eye, the container possesses the advantage of being easier for a human hand to grip when compared to a non-contoured container, and less likely to fall from a hand that is holding the container 10 because the upper body portion 50 is larger than the lower body portion 52. Additionally, the contour ribs 32, 62, 66, 70, 74, 98, 100 may have different dimensions to further enhance a human hand grip. Moreover, another advantage of using different contour rib dimensions is that an aesthetically pleasing container 10 may also be achieved. Yet another advantage of using different contour rib dimensions is structural support. At the larger diameter areas of the container 10, more structural support is required because the wall thickness in these areas generally tend to be thinner. As such, deeper, wider contour ribs are provided in these areas to add more structural support in these areas, thereby increasing the dent resistance and hoop strength in these areas.

The container 10 may have a contour land 54 in the upper body portion 50 with an outside diameter 56 of 64.5 mm (2.539 in.). As part of the gripping area of the container 10, a contour land 58 in the lower body portion 52 may have an outside diameter 60 of 52.62 mm (2.072 in.). Examples of other dimensions of the container 10 will also be presented. For instance, the distance between the lowest contour rib 32 and adjacent contour rib 62 may be a dimension 64, which may be 16.85 mm (0.663 in.). The dimension between contour rib 62 and adjacent contour rib 66 may be a dimension 68, which may be 16.85 mm (0.663 mm). While the dimensions 64 and 68 may be identical, one will notice from the scale drawing of FIG. 4, that the contour lands 30 and 78 have different profiles and exterior shapes. That is, contour land 30 has a convex exterior profile 80 while contour land 78 has a concave exterior profile 82. Continuing with the contour ribs, the distance between contour rib 66 and contour rib 70 is denoted by dimension 72, which may be 15.69 mm (0.618 in.). Similarly, the distance between contour rib 70 and contour rib 74 is denoted by dimension 76, which may be 15.49 mm (0.610 in.).

Continuing with FIG. 4, the base portion 26 will be further discussed. More specifically, the base portion 26 may have a recessed portion known as a push-up 84 that lies within a contact ring 86. The push-up 84 may be molded to contain its own strengthening ribs (not depicted) and several pieces of identifying information (not depicted), such as a product ID, recycling logo, corporate loge, etc. The contact ring 86 may be the flat area of the container 10 that contacts a support surface when the container 10 is in its upright position. More specifically, the contact ring 86 lies outside of the area of the push-up 84 and within an overall outside diameter 92 of the base portion 26. With regard to example dimensions of features in the base portion 26, a diameter 88 of the push-up 84 may be 42.17 mm (1.660 in.), an outside diameter 90 of the contact ring 86 may be 53.46 mm (2.105 in.), and the overall outside diameter 92 of the base portion 26 may be 64.5 mm (2.539 in.). Continuing with reference to FIG. 4, the base clearance or depth 94 of the push-up 84 may be 9.85 mm (0.388 in.) and the overall length or height 96 of the container 10 may be 167.66 mm (6.601 in.). A distance 134 from the top of the container 10 to the bottom of the support ring 34 may be 19.41 mm (0.764 in.) and a distance 136 from the top of the container 10 to a liquid fill level 138 may be 28.4 mm (1.118 in.).

Figure 5:
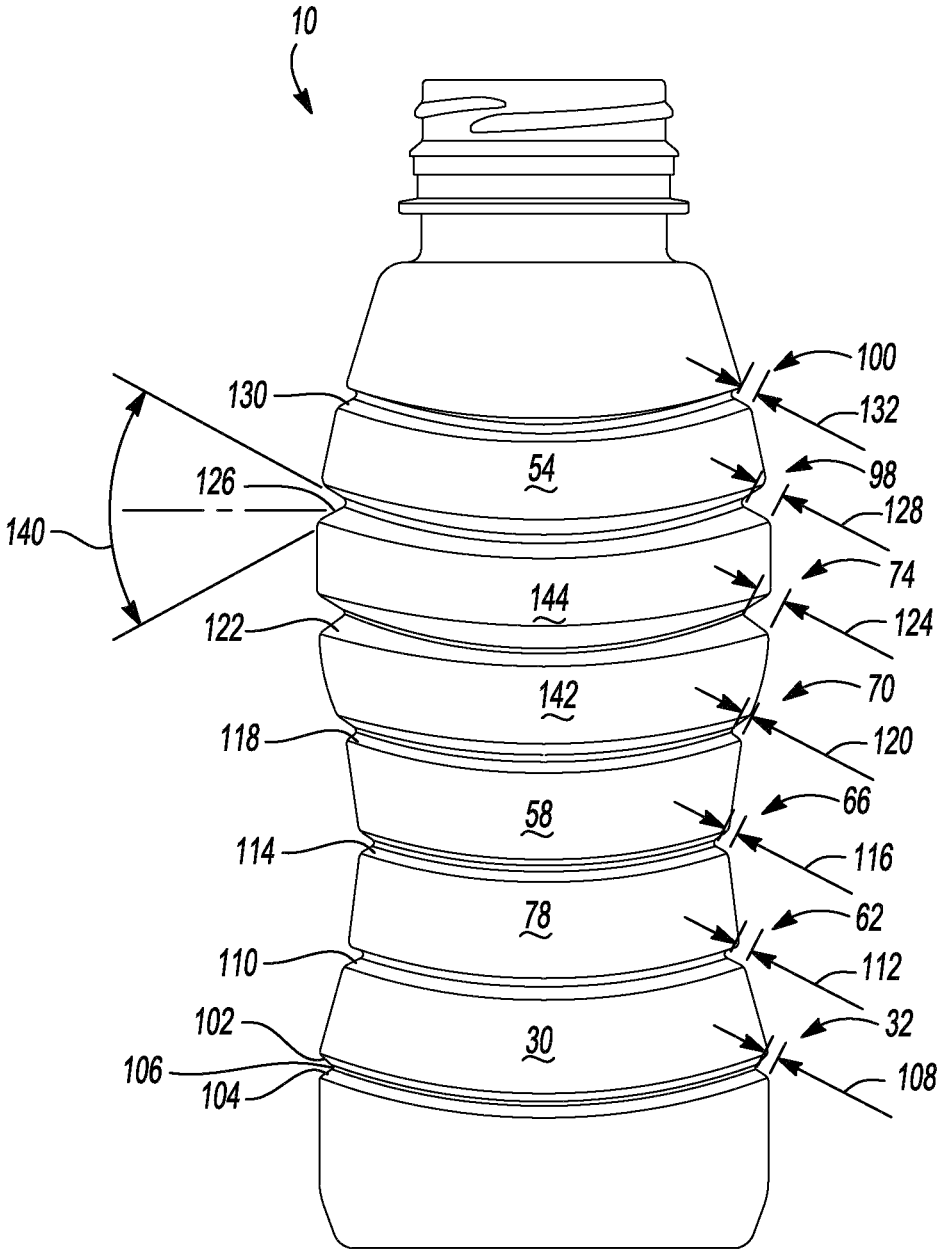
FIG. 5 is a right side view of the container depicting various contour rib and contour land dimensions.

Turning now to FIG. 5, details and example dimensions of the contour ribs 32, 62, 66, 70, 74, 98, 100 will be discussed. More specifically, the contour ribs may each have an upper wall 102 and a lower wall 104 separated by an inner curved wall 106, which is in part defined by a relatively sharp or small innermost radius. The relatively sharp innermost radius of inner curved wall 106 facilitates improved material flow during blow molding of the plastic container 10 thus enabling the formation of relatively deep contour ribs. The relatively deep contour ribs 32, 62, 66, 70, 74, 98, 100 are generally better able to absorb internal vacuum pressure and forces due to top loading than more shallow ribs, because a longer upper wall 102 and a longer lower wall 104 provide more of a cantilever to pivot at the inner curved wall 106. The contour ribs 32, 62, 66, 70, 74, 98, 100 depicted in FIG. 5 may have an upper wall and a lower wall that are tangent to the curvature of the inner curved wall 106.

Continuing with FIG. 5, the container 10 may utilize a contour rib 32 employing a lower wall 104 with a length 108 of 2.19 mm (0.086 in.), a contour rib 62 employing a lower wall 110 with a length 112 of 2.67 mm (0.105 in.), a contour rib 66 employing a lower wall 114 with a length 116 of 2.23 mm (0.088 in.), a contour rib 70 employing a lower wall 118 with a length 120 of 1.84 mm (0.072 in.), a contour rib 74 employing a lower wall 122 with a length 124 of 4.25 mm (0.167 in.), a contour rib 98 employing a lower wall 126 with a length 128 of 4.53 mm (0.178 in.), and a contour rib 100 employing a lower wall 130 with a length 132 of 2.75 mm (0.108 in.). The top wall corresponding to each of the lower walls 104, 110, 114, 118, 122, 126, 130 may be different in length from the lower walls 104, 110, 114, 118, 122, 126, 130 or the top wall length may be equal to its lower wall counterpart.

Contour ribs 32, 62, 66, 70, 74, 98, 100 are designed to achieve optimal performance with regard to vacuum absorption, top load strength and dent resistance by compressing slightly in a vertical direction to accommodate for and absorb vacuum forces resulting from hot-filling, capping and cooling of the container contents. Contour ribs 32, 62, 66, 70, 74, 98, 100 are designed to compress further when the filled container is exposed to excessive top load forces, such as during container stacking.

As depicted in FIG. 5, the above-described contour rib 98 has a radii, walls, depth and width, which in combination form a rib angle 140 that may be, in an unfilled plastic container 10, about 60 degrees. After hot-filling, capping and cooling of the container contents, the resultant vacuum forces may cause the rib angle 140 to reduce about 3 degrees as a result of vacuum forces present within the plastic container 10, representing a reduction in the rib angle 140 of about 5%. Preferably, the rib angle 140 will be reduced by at least about 3% and no more than about 8% as a result of internal vacuum pressure and resulting forces.

After filling, the plastic container 10 may be bulk packed on pallets and then stacked one on top of another resulting in top load forces being applied to the container 10 parallel to the central vertical axis L during storage and distribution. Thus, contour ribs 32, 62, 66, 70, 74, 98, 100 are designed so that the rib angle 140 may be further reduced to absorb top load forces. However, contour ribs 32, 62, 66, 70, 74, 98, 100 are designed so that the upper and lower walls, for example upper wall 102 and lower wall 104, never come into contact with each other as a result of vacuum or top load forces. Instead, contour ribs 32, 62, 66, 70, 74, 98, 100 may be designed to allow the container 10 to be supported in part by the product inside when exposed to excessive top load forces thereby preventing permanent distortion of the container 10. Additionally, this enables contour ribs 32, 62, 66, 70, 74, 98, 100 to rebound and return substantially to the same shape as before the top load forces were applied, once such top load forces are removed.

As depicted in FIG. 5, contour lands 30, 54, 58, 78, 142, 144 are generally either concave inward or concave outward, depending upon their location in the container 10, as molded. When the container 10 is subjected to vacuum and/or top load forces, contour lands 30, 54, 58, 78, 142, 144 are designed to bulge slightly outward to aid the container 10 in absorbing such forces.

The container 10 has been designed to retain a commodity, which may be in any form, such as a solid or liquid product. In one example, a liquid commodity may be introduced into the container 10 during a thermal process, typically a hot-fill process. For hot-fill bottling applications, bottlers generally fill the container 10 with a liquid or product at an elevated temperature between approximately 155° F. to 205° F. (approximately 68° C. to 96° C.) and seal the container 10 with a cap or closure before cooling. In addition, the container 10 may be suitable for other high-temperature pasteurization or retort filling processes or other thermal processes as well. In another example, the commodity may be introduced into the container 10 under ambient temperatures.

With continued reference to FIGS. 1-5 what is disclosed is a one-piece plastic container 10 employing an upper portion 14, a base portion 26 closing off the end of the container 10, and a plurality of arched contour ribs 32, 62, 66, 70, 74, 98, 100 molded into a sidewall portion 24. The sidewall portion 24 may be integrally formed with and extending from the upper portion 14 to the base portion 26. The sidewall portion 24 may further employ an upper body portion 50 and a lower body portion 52 such that an outside diameter of the upper body portion 50 is greater than an outside diameter of the lower body portion 52. The base portion 26 may have an outside diameter that is greater than the outside diameter of the lower body portion 52 and that is equal to the outside diameter of the upper body portion 50. When the container is viewed in a side profile, such as depicted in FIGS. 1 and 2, for example, the shape of the container 10 may be in the form of an hourglass with the lower body portion 52 forming the hand grip area. The sidewall portion 24 may further employ a plurality of contour lands 30, 54, 58, 78, 142, 144, with one contour land lying between a pair of contour ribs 32, 62, 66, 70, 74, 98, 100. For instance, contour land 58 lies between contour rib 66 and contour rib 70. By arranging the contour lands and contour ribs in the manner described above, the container 10 will appear, after contraction of an internal liquid, to not be changing shape, when in reality its shape has slightly changed (e.g. contracted). Regardless of the contraction of the internal liquid, the container 10 has a look such that the combined side profile shape of the upper body portion 50, the lower body portion 52 and the base portion 26 of the container 10 is an hourglass.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A one-piece plastic container having a longitudinal container axis comprising:

an upper portion;

a base portion closing off the end of the container; and a plurality of arched contour ribs molded into a sidewall portion, the sidewall portion integrally formed with and extending from the upper portion to the base portion, the plurality of arched contour ribs each having a longitudinal rib axis, the longitudinal rib axis curving around the longitudinal container axis, the longitudinal rib axis also curving toward the upper portion and toward the base portion to define a plurality of peaks and a plurality of troughs, the plurality of peaks and the plurality of troughs in alternating arrangement about the longitudinal container axis, the plurality of arched contour ribs each having a depth measured from an area of the sidewall portion that is adjacent to the respective rib, at least two of the plurality of arched contour ribs having different depths, each of the plurality of arched contour ribs defined by an upper wall and a lower wall that are joined by a curved inner wall having an innermost sharp radius, the upper wall and the lower wall have different lengths, are tangent to the inner curved wall, provide a cantilever to pivot at the inner curved wall and are configured to move toward each other in response to an internal vacuum pressure of the container, and a plurality of contour lands, each contour land lying between a pair of contour ribs, adjacent contour lands having different profiles and exterior shapes;

wherein the upper and lower walls define a rib angle therebetween that after hot-filling is reduced by at least about 3% and no more than about 8% due to internal vacuum pressure.

2. The container of claim 1, wherein the sidewall portion further comprises:

an upper body portion; and a lower body portion, wherein an outside diameter of the upper body portion is greater than an outside diameter of the lower body portion.

3. The container of claim 2, wherein the base portion has an outside diameter that is greater than the outside diameter of the lower body portion.

4. The container of claim 3, wherein the base portion has an outside diameter that is equal to the outside diameter of the upper body portion.

5. The container of claim 1, wherein a side profile shape of the container is an hourglass.

6. A one-piece plastic container having a longitudinal container axis comprising:

an upper portion;

a base portion closing off the end of the container;

a sidewall portion integrally formed with and extending from the upper portion to the base portion, wherein the sidewall portion comprises an upper body portion, a lower body portion, and a base body portion, wherein an outside diameter of the upper body portion is greater than an outside diameter of the lower body portion and equal to an outside diameter of the base body portion, wherein a combined side profile shape of the upper body portion, lower body portion and base body portion of the container is an hourglass, the sidewall portion further comprising:

a plurality of arched contour ribs each having a longitudinal rib axis, the longitudinal rib axis curving around the longitudinal container axis, the longitudinal rib axis also curving toward the upper portion and toward the base portion to define a plurality of peaks and a plurality of troughs, the plurality of peaks and the plurality of troughs in alternating arrangement about the longitudinal container axis, the plurality of arched contour ribs each having a depth measured from an area of the sidewall portion that is adjacent to the respective rib, at least two of the plurality of arched contour ribs having different depths, each of the plurality of arched contour ribs being defined by an upper wall and a lower wall that are joined by a curved inner wall having an innermost sharp radius, the upper wall and the lower wall have different lengths, are tangent to the inner curved wall, provide a cantilever to pivot at the inner curved wall and are configured to move toward each other in response to an internal vacuum pressure of the container; and a plurality of arched contour lands, the arched contour ribs and arched contour lands alternating along the longitudinal container axis, adjacent contour lands having different profiles and exterior shapes;

wherein the upper and lower walls define a rib angle therebetween that after hot-filling is reduced by at least about 3% and no more than about 8% due to internal vacuum pressure.

7. The container of claim 6, wherein the upper wall, the lower wall, and the inner wall together form an angle of 60 degrees.

8. The container of claim 6, wherein the arched contour lands of the lower body portion are contoured concave inwardly for gripping by a human hand.

9. A one-piece plastic container having a longitudinal container axis comprising:

a shoulder portion;

a base portion closing off the end of the container;

a sidewall portion integrally formed with and extending from the shoulder portion to the base portion, the sidewall portion further comprising:

a plurality of arched contour ribs each having a longitudinal rib axis, the longitudinal rib axis curving around the longitudinal container axis, the longitudinal rib axis also curving toward the shoulder portion and toward the base portion to define a plurality of peaks and a plurality of troughs, the plurality of peaks and the plurality of troughs in alternating arrangement about the longitudinal container axis, the plurality of arched contour ribs each having a depth measured from an area of the sidewall portion that is adjacent to the respective rib, at least two of the plurality of arched contour ribs having different depths, each of the plurality of arched contour ribs defined by an upper wall and a lower wall that are joined by a curved inner wall having an innermost sharp radius, the upper wall and the lower wall have different lengths, are tangent to the inner curved wall, provide a cantilever to pivot at the inner curved wall and are configured to move toward each other in response to an internal vacuum pressure of the container;

a plurality of arched contour lands, the arched contour ribs and arched contour lands alternating along the longitudinal container axis, adjacent contour lands having different profiles and shapes;

a convex upper body portion; and a concave lower body portion, wherein an outside diameter of the upper body portion is greater than an outside diameter of the lower body portion, the lower body portion forming a hand grip area;

wherein the upper and lower walls define a rib angle therebetween that after hot-filling is reduced by at least about 3% and no more than about 8% due to internal vacuum pressure.

10. The container of claim 9, wherein the upper wall and the lower wall are both flat in a cross section taken through the arched contour ribs and the longitudinal container axis, and wherein the inner curved wall, the upper wall and the lower wall together form an angle of 60 degrees.

11. The container of claim 10, wherein the upper and lower walls are configured to move toward each other in response to container top load forces.

12. The container of claim 11, wherein an outside diameter of the upper body portion and an outside diameter of the base portion are equal.

13. The container of claim 12, wherein the arched contour lands of the lower body portion are concave for gripping by a human hand.

14. The container of claim 1, wherein the plurality of arched contour ribs include a first arched contour rib defined on a first area of the sidewall and a second arched contour rib defined on a second area of the sidewall, the first area having a larger outer diameter than the second area, the first arched contour rib having a greater depth of protrusion into the interior volume than the second arched contour rib.

15. The container of claim 1, wherein the plurality of arched contour ribs extend continuously about the longitudinal container axis.

16. The container of claim 1, wherein the sidewall portion defines a first portion with a first diameter and a second portion with a second diameter that is larger than the first diameter, wherein the depth of a first rib at the first portion is smaller than the depth of a second rib at the second portion.

17. The container of claim 16, wherein the first rib has a first width and the second rib has a second width that is larger than the first width.

* * * * *